United States Patent [19]

Kowal

[11] Patent Number: 4,624,225

[45] Date of Patent: Nov. 25, 1986

[54] SELF-CONTAINED LASH ADJUSTER WITH DIAPHRAGM-TYPE SEAL

[75] Inventor: Steven J. Kowal, Prospect Heights, Ill.

[73] Assignee: Stanadyne, Inc., Windsor, Conn.

[21] Appl. No.: 730,195

[22] Filed: May 3, 1985

[51] Int. Cl.[4] ..... F01L 1/24

[52] U.S. Cl. ..... 123/90.58; 123/90.55

[58] Field of Search ..... 123/90.58, 90.55, 90.56, 123/90.57, 90.46, 90.59

[56] References Cited

U.S. PATENT DOCUMENTS

| | | | |
|---|---|---|---|
| 2,109,815 | 3/1938 | Best | 123/90.58 |
| 2,833,257 | 5/1958 | Lengnick | 123/90.58 |
| 3,495,577 | 2/1970 | Collins | 123/90.58 |
| 3,521,608 | 7/1970 | Scheibe | 123/90.58 |
| 4,397,271 | 8/1983 | Gardner | 123/90.58 |

FOREIGN PATENT DOCUMENTS

| | | | |
|---|---|---|---|
| 146210 | 11/1980 | Japan | 123/90.58 |
| 160106 | 12/1980 | Japan | 123/90.58 |
| 2089923 | 6/1982 | United Kingdom | 123/90.55 |

*Primary Examiner*—Ira S. Lazarus

*Attorney, Agent, or Firm*—Kinzer, Plyer, Dorn & McEachran

[57] ABSTRACT

A self-contained lash adjuster has a generally cup-shaped follower and a spacer mounting a lash adjuster cartridge assembly within the follower. The cartridge assembly includes a movable body and a plunger, with a high pressure chamber being defined between the plunger and body. A check valve controls fluid flow through a plunger passage into the high pressure chamber. There is a diaphragm seal which is attached at its outer periphery to an interior wall of the follower and attached at its inner periphery to the movable body. The seal in part defines a fluid reservoir. There is a passage connecting the reservoir with the cartridge assembly. Movement of the body toward the plunger moves fluid from the high pressure chamber to the fluid reservoir, causing a stretching of the diaphragm seal.

3 Claims, 1 Drawing Figure

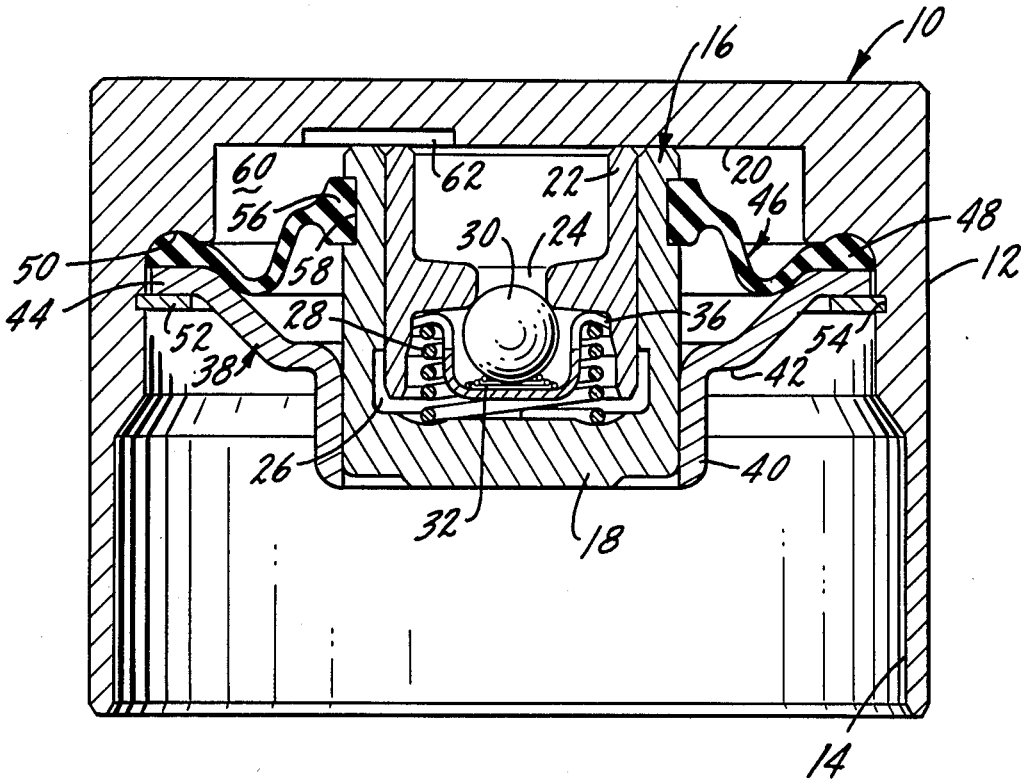
10
16
60
62
22
20
56
46
48
30
24
50
58
12
44
28
36
52
54
38
42
26
40
32
18
14

SELF-CONTAINED LASH ADJUSTER WITH DIAPHRAGM-TYPE SEAL

SUMMARY OF THE INVENTION

The present invention relates to self-contained hydraulic lash adjusters and in particular to a diaphragm seal which is positioned within the lash adjuster and defines a fluid reservoir for hydraulic fluid therein.

A primary purpose of the invention is a hydraulic lash adjuster of the type described utilizing a diaphragm seal which is attached at its inner periphery to the movable body of the lash adjuster cartridge assembly and is attached at its outer periphery to an interior wall of the follower.

Another purpose is a lash adjuster of the type described in which the diaphragm seal has a greater radial length than the space between the elements to which it is connected, thereby permitting expansion of the seal when under pressure from fluid within the lash adjuster cartridge assembly.

Another purpose is a simply constructed, reliably operable self-contained hydraulic lash adjuster of the type described.

Other purposes will appear in the ensuing specification, drawing and claims.

BRIEF DESCRIPTION OF THE DRAWINGS

The invention is illustrated diagrammatically in the attached axial section through a hydraulic lash adjuster of the type described.

DESCRIPTION OF THE PREFERRED EMBODIMENT

U.S. Pat. No. 4,397,271, assigned to the assignee of the present application, shows a semi-self-contained hydraulic lash adjuster using a diaphragm seal. The present invention utilizes a diaphram seal in a self-contained lash adjuster in which the seal defines a fluid reservoir in communication with the lash adjuster high pressure chamber. The seal is fixed to both the movable body forming one element of the lash adjuster cartridge assembly and to the interior wall of the follower. The diaphragm seal can expand and contract during operation of the lash adjuster as fluid is moved between the high pressure chamber and the reservoir during normal engine operation.

One of the advantages of a self-contained lash adjuster is that it prevents aerated oil reaching the high pressure chamber in the adjuster, thus reducing the possibility of a noisy tappet or lash adjuster. However, in such a self-contained lash adjuster it is necessary that the reservoir of hydraulic fluid be permanently and satisfactorily sealed so as to prevent loss of fluid. The present invention provides an improved type of diaphragm seal which is firmly attached at its inner and outer peripheries to elements of the lash adjuster so that the fluid reservoir maintains its integrity over the long period of time and long mileage requirements placed on lash adjusters in state-of-the-art engines.

The lash adjuster will be positioned axially above the engine valve and immediately below an overhead cam. The lash adjuster disclosed herein is specifically designed for use in small efficient internal combustion engines utilizing overhead cams.

In the drawing, the lash adjuster follower is indicated generally at 10 and is a cup-shaped element having an outer wall 12 and an interior wall 14. Positioned within the interior of follower 10 is a lash adjuster cartridge assembly 16 consisting of a body 18 which is movable toward and away from interior end face 20 of the follower and a plunger 22. The plunger is mounted within body 18 and there is a plunger passage 24 which connects to a high pressure chamber 26 formed between the plunger and the body. A coil spring 28 normally urges body 18 away from the plunger or to what is termed as the extended position of the lash adjuster cartridge assembly. The non-extended or bottomed position is shown in the drawing. A check valve 30 closes passage 24 and is urged toward the closing position illustrated by a coil spring 32 held in position by a retainer 36.

A spacer 38 is used to mount lash adjuster cartridge assembly 16 within follower 10. The spacer includes an axial wall 40 in sliding engagement with the exterior of body 18 and a generally radially extending wall 42, the outer periphery of which terminates in a flange 44 which is in peripheral contact with the interior wall of follower 10.

A diaphragm seal is indicated generally at 46 and is attached at its inner and outer peripheries to the body and follower, respectively. At the outer periphery, the diaphragm seal has an enlarged area 48 which fits within a recess 50 in the interior wall of follower 10. Flange 44 of spacer 38 abuts enlarged area 50 and a retaining ring 52, positioned within a groove 54 in the interior wall of the follower, holds the assembly in position. In the assembly process, the diaphragm seal is first positioned within the recess in the follower wall, then the spacer is positioned on top of the seal and then the retaining ring is snapped into its groove which compresses the enlarged area of the diaphragm seal to thus form a firm and positive seal connection with the follower wall.

At its interior periphery, the diaphragm seal has a further enlarged area 56 which fits within a recess 58 in the exterior wall of body 18. As the body moves between its extended and non-extended positions, when it is in the extended position, the interior peripheral enlarged area 56 will abut the end of spacer cylindrical wall 40.

Diaphragm seal 46, along with the interior wall of the follower and end face 20 form a reservoir 60 which is in communication with the interior of plunger 22 by means of a passage 62 formed in face 20. The reservoir will be filled with hydraulic fluid during assembly and prior to insertion of the diaphragm and cartridge assembly. The amount of fluid utilized is sufficient to last for the duration of the life of the lash adjuster.

The material of seal 46 is important as it must withstand the temperatures and operating conditions associated with lash adjuster utility and it must be resistant to the silicon compositions which are included in hydraulic fluid. A material sold under the trademark VAMAC has been found to be one satisfactory material. In addition, the material must have a degree of stretch or elasticity. When the lash adjuster body is in the non-extended or bottomed position shown, hydraulic fluid from high pressure chamber 26 is moved from the cartridge assembly into reservoir 60 which has the effect of stretching the seal. The seal must permit such stretch, but yet have a degree of resilience such that when the body moves to the lash adjuster extended position, the resiliency of the diaphragm seal will assist in urging fluid from reservoir 60 back into the high pressure chamber. There must be sufficient fluid pressure to move check valve 30 away from its seat so that the fluid passing from the reservoir through passage 62 can in fact return to the high pressure chamber.

The size of the diaphram seal is also important. Assuming a radial distance of approximately 0.200" between the outer wall of the body and the inner wall of the follower, it has been found that a diaphragm seal having a radial distance of 0.350" is satisfactory. The actual distances will vary, depending upon the size of the follower. However, a ratio of diaphragm radial distance to the space between the body and the follower of one-and-a-half to two has been found to provide a very satisfactory seal.

Whereas the preferred form of the invention has been shown and described herein, it should be realized that there may be many modifications, substitutions and alterations thereto.

The embodiments of the invention in which an exclusive property or privilege is claimed are defined as follows:

1. A self-contained lash adjuster including a generally cylindrical cup-shaped follower, a lash adjuster cartridge assembly, a spacer mounting said cartridge assembly within said follower, said cartridge assembly including a reciprocally movable body and a plunger within said body, a high pressure chamber defined between said plunger and body, a plunger passage opening into said high pressure chamber, a check valve controlling flow through said plunger passages, and a diaphragm-type seal attached at its outer periphery to an interior wall of said follower and attached at its inner periphery to the movable body, an annular recess formed in the interior wall of said follower, the outer periphery of said diaphragm seal having an enlarger area positioned within said recess, with said spacer holding the outer periphery of said diaphragm seal and the enlarged area thereof in said recess, said diaphragm seal having a radial distance between its inner and outer peripheries on the order of about 1.5 to 2 times the radial distance between said body and follower interior wall spanned by said diaphragm, said diaphragm-type seal and follower interior wall defining a fluid reservoir, passage means connecting said reservoir with said cartridge assembly, movement of said body toward the plunger moving fluid from said cartridge assembly to said reservoir and causing a stretching of said diaphragm-type seal.

2. The lash adjuster of claim 1 further characterized by and including a peripheral groove on the exterior of said body, the inner periphery of said diaphragm seal having an enlarged area positioned within said groove to thereby attach the inner periphery of said seal to said body.

3. The lash adjuster of claim 1 further characterized in that said spacer has a generally cylindrical portion supporting said cartridge assembly body, and an outwardly-extending flange which supports and holds the outer periphery of said diaphragm seal in said follower interior wall recess, and a retainer fastened to the interior wall of said follower and compressing the enlarged outer area of said diaphragm seal.

* * * * *